US005551687A

United States Patent [19]

Krull

[11] Patent Number: 5,551,687

[45] Date of Patent: Sep. 3, 1996

[54] TOY HAVING MULTIPLE TAGS

[76] Inventor: Mark A. Krull, 7932 Somerset Rd., Woodbury, Minn. 55125

[21] Appl. No.: 373,476

[22] Filed: Jan. 17, 1995

Related U.S. Application Data

[63] Continuation of Ser. No. 148,387, Nov. 8, 1993, abandoned.

[51] Int. Cl.[6] ..... A63B 37/14; A63H 33/04

[52] U.S. Cl. ..... 273/58 K; 273/58 A; 273/58 C; 446/85; 446/901

[58] Field of Search ..... 446/85, 268, 369, 446/385, 431, 901; 273/58 R, 58 C, 58 K

[56] References Cited

U.S. PATENT DOCUMENTS

| | | | |
|---|---|---|---|
| 1,644,317 | 10/1927 | Willey | 446/369 |
| 2,347,405 | 4/1944 | Ford | 446/369 |
| 3,117,384 | 1/1964 | Billis | 446/901 X |
| 3,470,845 | 10/1969 | Mignano | 273/58 K X |
| 4,200,288 | 4/1980 | di Donato | 273/58 K X |
| 4,208,832 | 6/1980 | Corriveau | 446/369 X |
| 4,321,888 | 3/1982 | Topliffe | 273/58 K X |
| 4,599,077 | 7/1986 | Vuillard | 446/85 |
| 4,883,441 | 11/1989 | Byer | 446/901 X |
| 4,927,141 | 5/1990 | Paranto | 273/58 C X |
| 4,963,117 | 10/1990 | Gualdoni | 446/901 X |
| 4,968,279 | 11/1990 | Smith | 446/369 X |
| 5,027,457 | 7/1991 | Sweet | 446/369 X |
| 5,228,690 | 7/1993 | Rudell et al. | 273/58 K X |
| 5,265,559 | 11/1993 | Borell | 273/58 K X |

FOREIGN PATENT DOCUMENTS

| | | | |
|---|---|---|---|
| 141648 | 4/1920 | United Kingdom | 446/369 |
| 8809198 | 12/1988 | WIPO | 446/369 |

*Primary Examiner*—Mickey Yu
*Assistant Examiner*—D. Neal Muir
*Attorney, Agent, or Firm*—Mark A. Krull

[57] ABSTRACT

The present invention provides a toy having multiple tags that serve a variety of purposes including amusement, education, and/or third party advertising.

6 Claims, 8 Drawing Sheets

TOY HAVING MULTIPLE TAGS

This application is a continuation of Ser. No. 08/148,387 filed on Nov. 8, 1993, now abandoned.

FIELD OF THE INVENTION

The present invention relates to toys having multiple tags attached thereto.

BACKGROUND OF THE INVENTION

A tag is typically sewn onto a stuffed toy to provide information about the toy and/or its manufacturer. Such a tag is designed to be relatively inconspicuous and is not intended to be a primary feature of the toy. However, at least some infants seem to focus their attention on the tag more than any other feature of the stuffed toy. Hence, one object of the present invention is to provide a stuffed toy with several tags intended to function as one of the primary features of the toy.

Another object of the present invention is to provide a stuffed toy with a variety of tags, distinguished by size, shape, and/or color.

Another object of the present invention is to provide a stuffed toy with a variety of tags, some of which are permanently secured to the toy, and some of which are releasably secured to the toy.

Another object of the present invention is to provide a stuffed toy with a variety of tags, which are varied and arranged to suit a particular amusement or educational purpose.

Another object of the present invention is to provide advertising for one or more third parties by offering "space" on one or more tags on a stuffed toy.

Another object of the present invention is to provide stuffed toys with interconnecting tags.

Additional objects of the present invention will become apparent from the description that follows.

SUMMARY OF THE INVENTION

The present invention provides a stuffed ball having a plurality of tags attached thereto. The tags are made of various cloths having different colors and/or textures and secured to the ball by various means for purposes of education, as well as amusement. The tags are also suitable for displaying third party advertising. The many advantages of the present invention will become apparent upon a more detailed description of the invention.

BRIEF DESCRIPTION OF THE DRAWING

With reference to the Figures, wherein like numerals represent like parts throughout the several views.

DETAILED DESCRIPTION OF A PREFERRED EMBODIMENT

Figure 1:
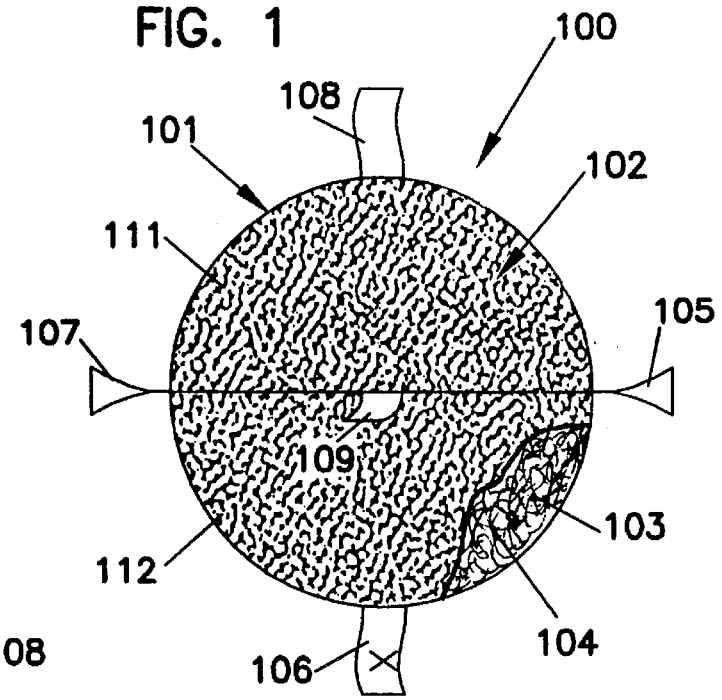
FIG. 1 is a front view of a stuffed toy constructed according to the principles of the present invention.
Figure 2:
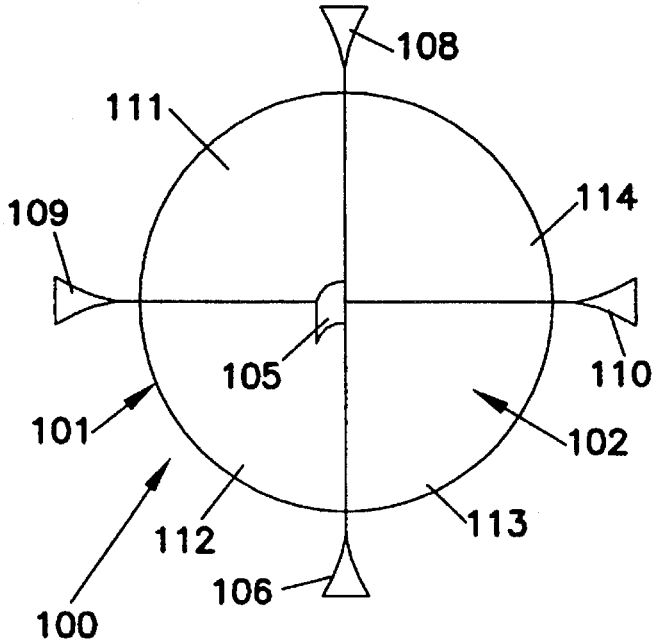
FIG. 2 is a top view of the stuffed toy shown in FIG. 1.
Figure 3:
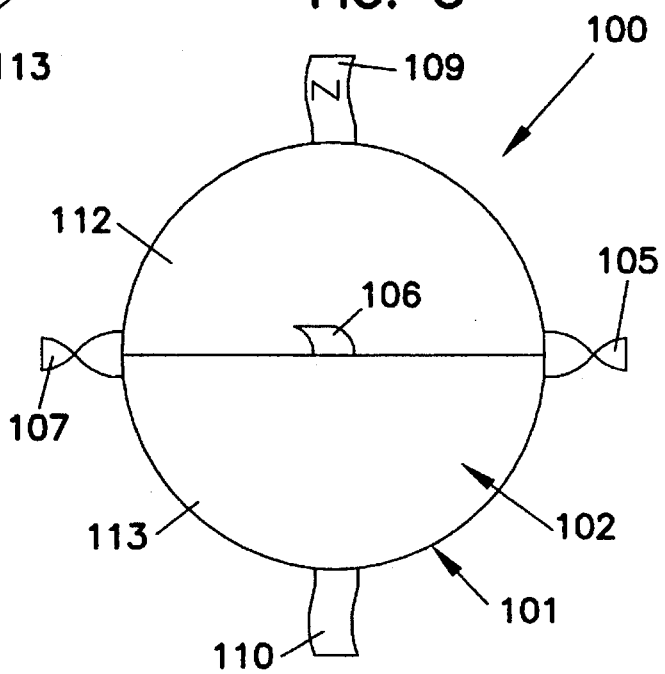
FIG. 3 is a side view of the stuffed toy shown in FIG. 1.

A stuffed toy constructed according to the principles of the present invention is designated as 100 in FIGS. 1–3. The toy 100 includes a fabric housing 101 having an outer surface or exterior 102 and an inner space or interior 103. A stuffing material 104 is disposed within the interior 103 so that the toy 100 assumes the approximate shape of a sphere. A plurality of tags 105–110 are disposed on the exterior 102 at diametrically opposed positions on each of the three axes of the sphere.

The Figures are not necessarily indicative of the relative sizes of the tags 105–110 and the toy 100. In a preferred embodiment, the length and width of the tags 105–110 are approximately one-half of the radius of the spherical toy 100. Also, each of the tags 105–110 may bear the logo or trademark of a different company for advertising purposes, as well as aesthetic purposes. Such advertising is represented by the "X" on tag 106 in FIG. 1, and the "Z" on tag 109 in FIGS. 3 and 10. In this regard, the present invention may also be said to provide a method of advertising, which is not only inobtrusive, but actually enhances the visual appeal of the toy.

Figure 10:
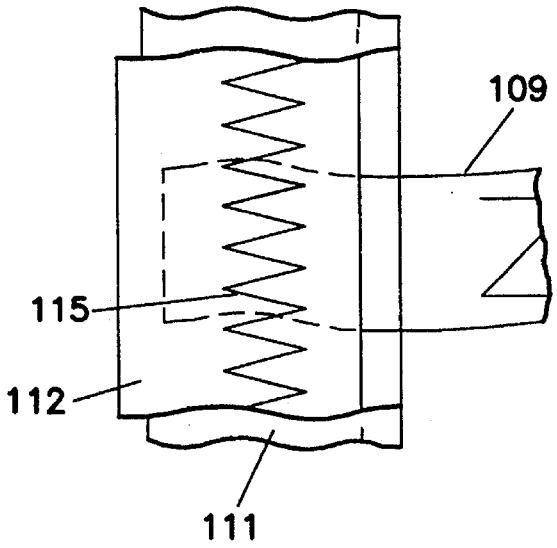
FIG. 10 is a front view of a seam in which a tag, such as those on the stuffed toys shown in FIGS. 1–6, is mounted.
Figure 11:
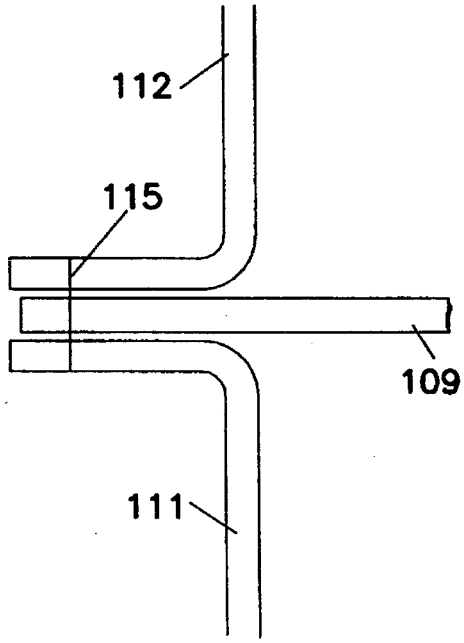
FIG. 11 is a side view of the seam shown in FIG. 10.

In a preferred embodiment, the fabric housing 101 includes a plurality of fabric segments 111–114 that are sewn together to form the fabric housing 101. As shown in FIGS. 10 and 11, wherein tag 109 is representative of tags 105–110, the cloth tag 109 is disposed between adjacent fabric segments 111 and 112 and secured in place by the same stitching 115 that secures the fabric segments 111 and 112 to one another. An obvious advantage of this particular arrangement is that no extra stitching is required to add tags to the stuffed toy.

In addition to providing advertising space, each of the plurality of tags provides an infant with an additional handhold or object on which to suck. The tags are arranged about the exterior of the ball in such a manner that several tags will be accessible regardless of the orientation of the ball. Amusement and/or education may be enhanced by providing tags of different colors and/or textures.

Figure 4:
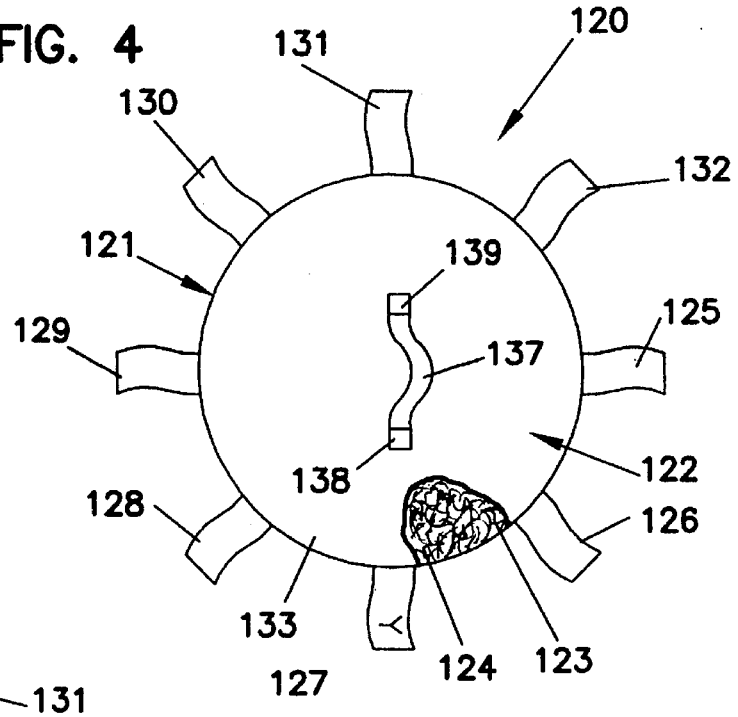
FIG. 4 is a top view of another stuffed toy constructed according to the principles of the present invention.
Figure 5:
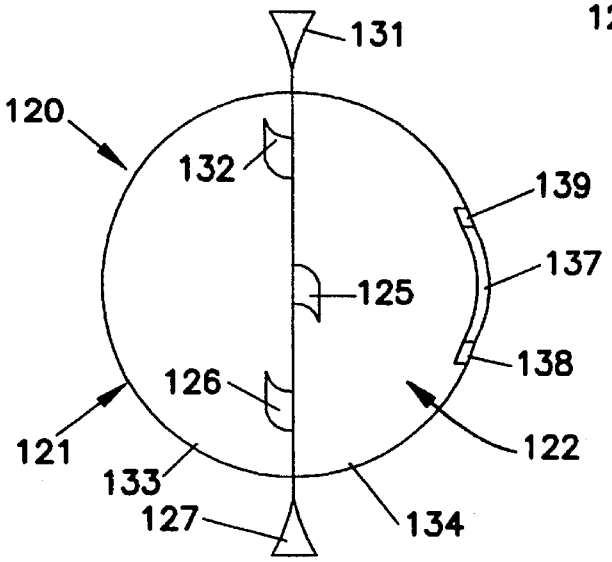
FIG. 5 is a front view of the stuffed toy shown in FIG. 3.
Figure 6:
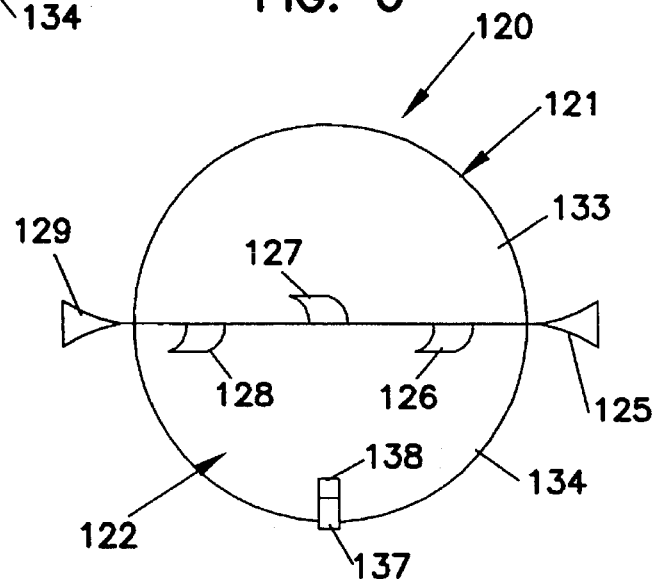
FIG. 6 is a side view of the stuffed toy shown in FIG. 4.

In another embodiment, shown in FIGS. 4–6, a stuffed ball 120 includes a fabric housing 121 having an exterior 122 and an interior 123. A stuffing material 124 is disposed within the interior 123 so that the toy 120 assumes the approximate shape of a sphere. A handle 137 extends between ends 138 and 139, which are sewn to the exterior 122 of the fabric housing 121. The handle 137 provides an additional diversion for an infant, as well as a means by which a toddler may grasp and/or carry the toy 120.

A plurality of tags 125–132 are disposed on the exterior 122 at equally spaced locations about a circumferential seam in the toy ball 120. In this embodiment 120, the length and width of the tags 125–132 are approximately three-eighths of the radius of the spherical toy 120. Again, each of the tags 125–132 may be a different color and/or texture or may bear the logo or trademark of a different company for advertising purposes, as well as aesthetic purposes, as represented by the "Y" on the tag 127 in FIG. 4. The tags 125–132 are secured within the seam between the fabric segments 133 and 134, in the same manner as the tags 105–110 are sewn onto the embodiment 100 described above.

Figure 7:
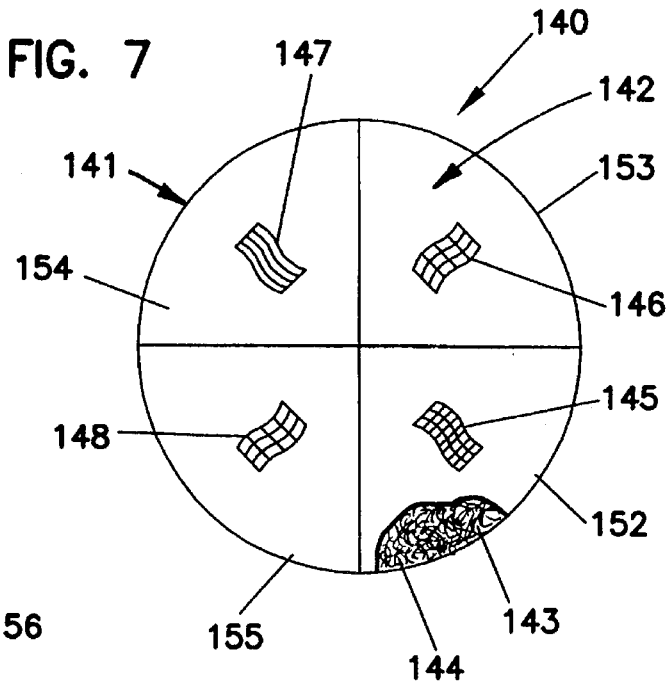
FIG. 7 is a front view of yet another stuffed toy constructed according to the principles of the present invention.
Figure 8:
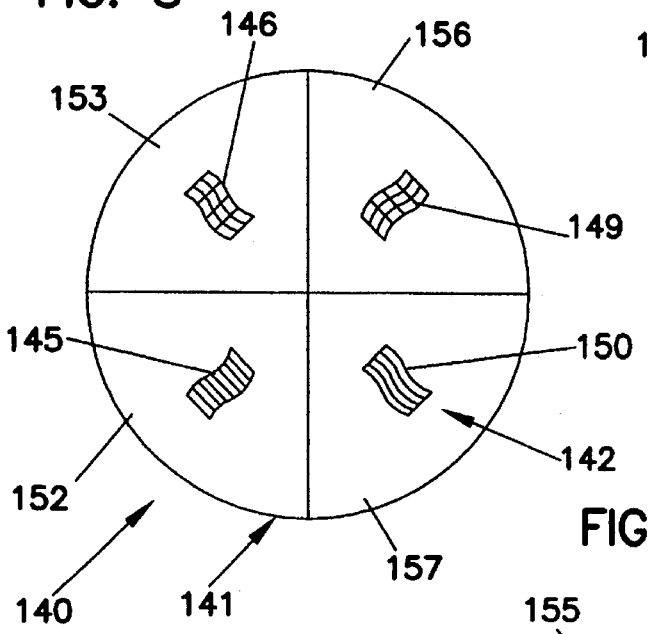
FIG. 8 is a top view of the stuffed toy shown in FIG. 7.
Figure 9:
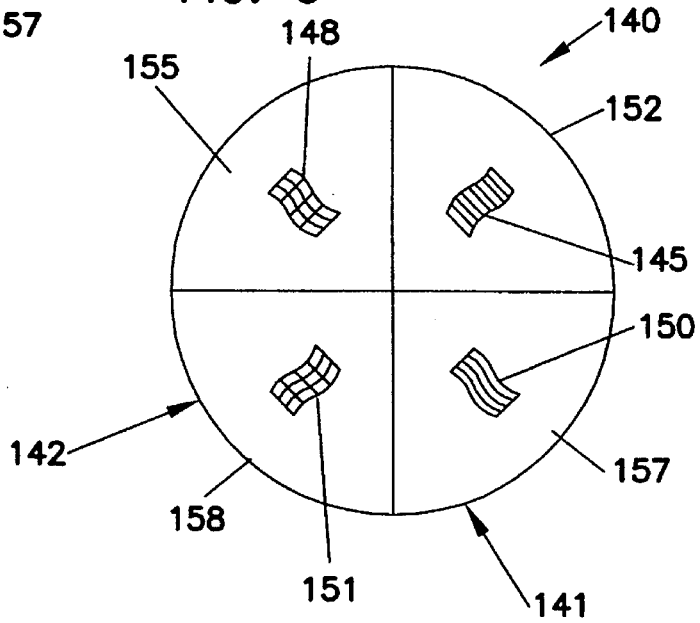
FIG. 9 is a side view of the stuffed toy shown in FIG. 7.

Tags may be secured to the fabric housing in other manners, as well. For example, three different fastening methods are used to attach tags to the toy 140 that is shown in FIGS. 7–9. The stuffed ball 140 includes a fabric housing 141 having an exterior 142 and an interior 143. A stuffing material 144 is disposed within the interior 143 so that the toy 140 assumes an approximately spherical shape. A plurality of tags 145–151 (and one not shown) are disposed on the exterior or outer surface 142 at locations equidistant from each of the three axes of the sphere. In this embodiment 140, the length and width of the tags 145–151 (and one not shown) are approximately one-half of the radius of the spherical toy 140.

Figure 12:
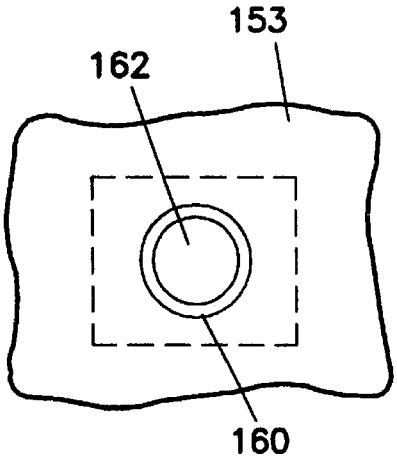
FIG. 12 is a top view of a portion of the stuffed toy shown in FIGS. 7–9, showing a means for mounting a tag to the stuffed toy.
Figure 13:
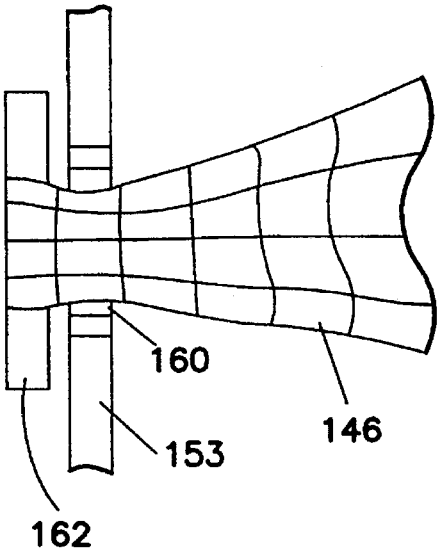
FIG. 13 is a side view of the portion shown in FIG. 12, showing a tag releasably anchored to the stuffed toy portion.

The tags 146, 148, 149, and 151 are checkered to designate the color yellow, and they are attached to the ball 140 in the manner shown in FIGS. 12 and 13. The tag 146, which is representative of the other yellow tags, is releasably anchored to the fabric housing portion 153 by means of an anchor member 161 secured to the tag 146. The length of the anchor member 161 is greater than the diameter of an eyelet 160 secured to the fabric housing portion 153. The anchor member 161 is flexible to the extent that an adult can bend the anchor member 161 and insert it through the eyelet 160, but an infant or young child cannot. Alternatively, the anchor member 161 could be rigid, and an adult could over insert one end of the anchor member 161 to gain clearance for the other end, and then center the anchor member 161 relative to the eyelet 160, so that it could not be extracted by an infant. In either case, a patch 162 is sewn about the eyelet 160 on the interior of the fabric housing portion 153 to prevent interference and/or escape of stuffing material. This particular tag fastening method provides the benefit of tag interchangeability for the sake of variety, as well as specific purposes involving amusement and/or education. For example, one could vary the number of yellow tags secured to the ball, so that a child can experience variety in locating and/or counting the yellow tags.

Figure 14:
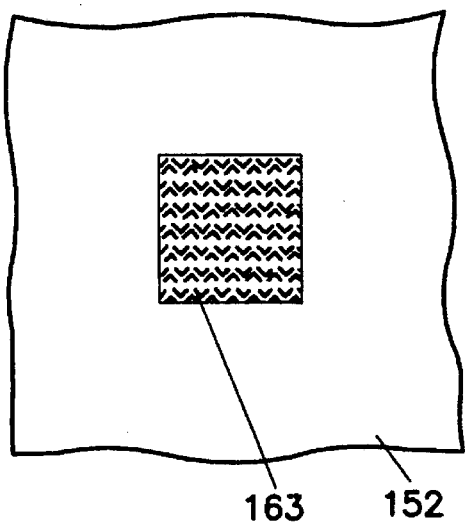
FIG. 14 is a top view of another portion of the stuffed toy shown in FIGS. 7–9, showing another means for mounting a tag to the stuffed toy.
Figure 15:
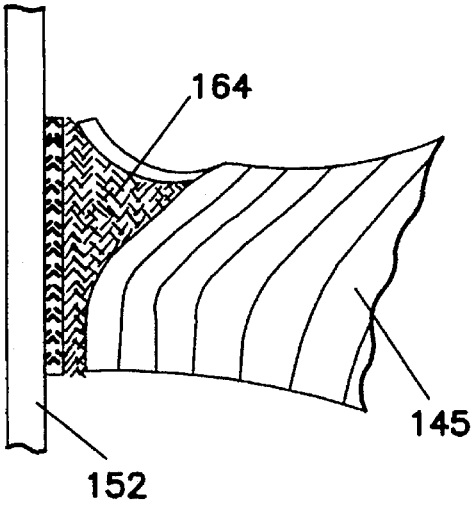
FIG. 15 is a side view of the portion shown in FIG. 14, showing a tag releasably fastened to the stuffed toy portion.

The tag 145 (as well as the one not shown) is patterned with transverse lines to designate the color blue, and it is attached to the ball 140 in the manner shown in FIGS. 14 and 15. The tag 145, as well as the one not shown, is releasably secured to the fabric housing portion 152 by means of hook and loop fasteners 163 and 164. In addition to the benefit of tag interchangeability, this particular tag fastening method also provides the benefit of tag removability by a small child for amusement and/or educational purposes. However, one obviously should not permit unsupervised use of removable tags by infants or young children who are susceptible to swallowing or choking on the tags.

Figure 16:
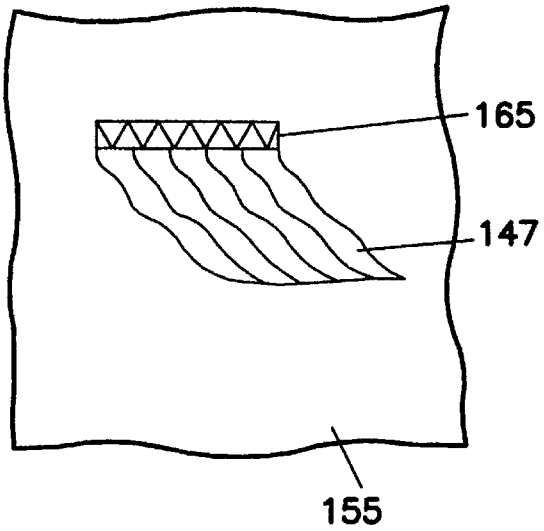
FIG. 16 is a top view of another portion of the stuffed toy shown in FIGS. 7–9, showing yet another means for mounting a tag to the stuffed toy.
Figure 17:
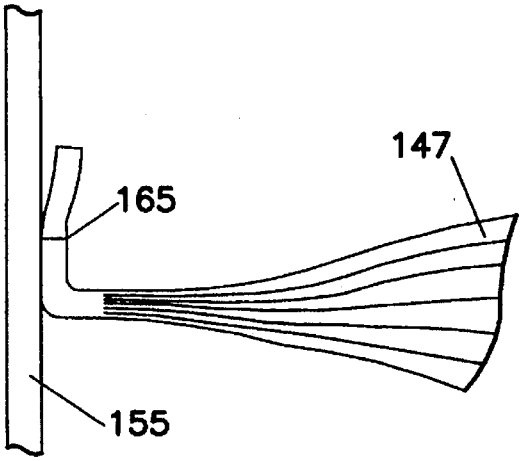
FIG. 17 is a side view of the portion shown in FIG. 16, showing a tag sewn to the stuffed toy portion.

The tags 147 and 150 are patterned with longitudinal lines to designate the color red, and they are attached to the ball 140 in the manner shown in FIGS. 16 and 17. The tag 147, which is representative of the other red tag 150, is sewn to a fabric housing portion 155 by stitching 165. This particular tag fastening method, as well as the preceding two methods, provides the benefit of greater freedom in designing a particular toy, because the available locations for the tags are not limited to the seams of the toy. This particular fastening method also eliminates any potential danger that an infant might remove a tag and swallow or choke on it. Use of any one of the tag fastening methods has its advantages, and additional advantages may be realized by combining the various methods. For example, color recognition can be facilitated by associating certain colors with certain fastening methods (i.e. red tags are not removable).

Any of the foregoing embodiments can also be modified by (1) locating a rattle within the interior of the fabric housing; (2) providing an extra long tag with hook and loop fastener means at each end, so that each end of the tag can be secured to a different hook and loop fastener means on the toy, in which case the extra long tag can function as a handle (an example is shown in FIG. 19); and/or (3) providing hook and loop fastener means on the end of one or more tags, so that objects such as teething rings can be secured relative to the toy.

Figure 18:
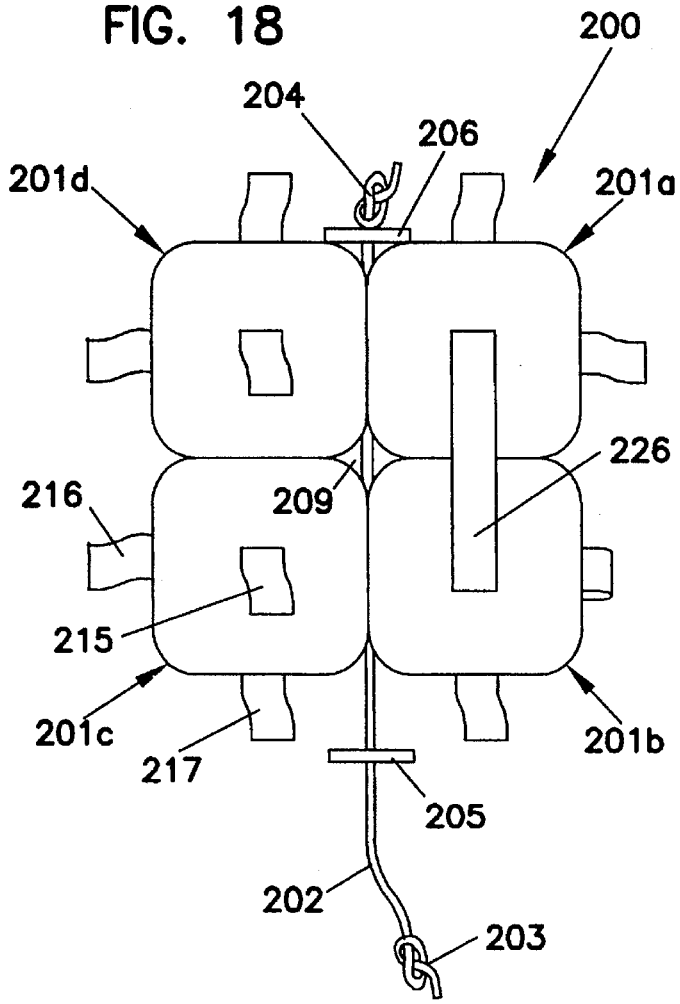
FIG. 18 is a front view of yet another stuffed toy constructed according to the principles of the present invention.
Figure 20:
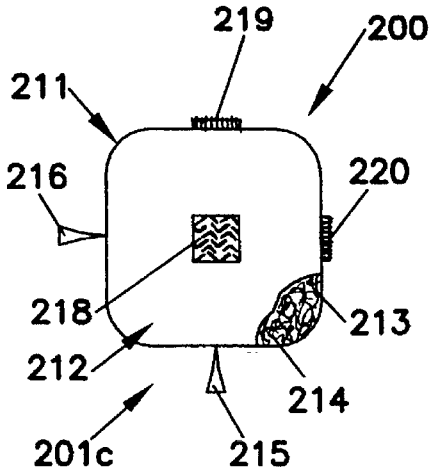
FIG. 20 is a top view of a yet another stuffed toy constructed according to the principles of the present invention, which serves as a component in the stuffed toy shown in FIGS. 18 and 19.
Figure 19:
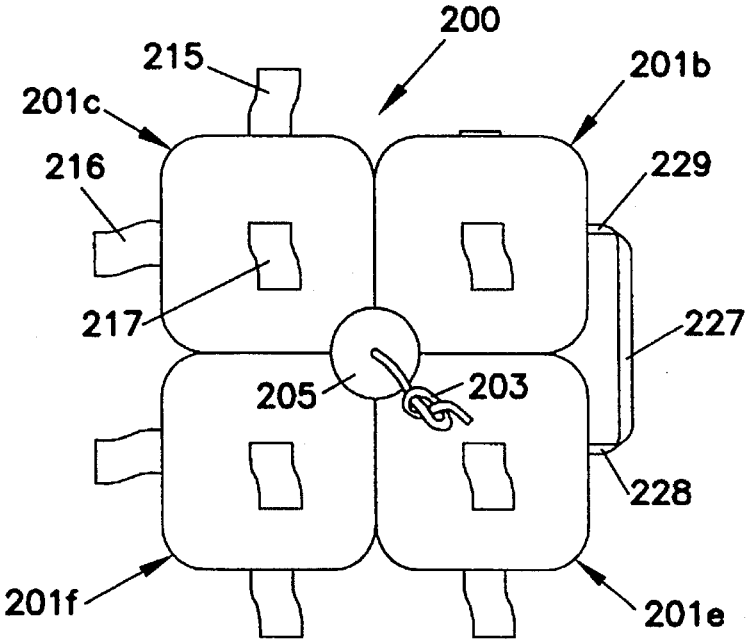
FIG. 19 is a top view of the stuffed toy shown in FIG. 18.

Yet another embodiment of the present invention is shown in FIGS. 18–20. The toy 200 comprises a set of modules 201*a–f* (and two not shown), one of which is designated as 201*c* and shown in greater detail in FIG. 20. The module 201*c* includes a fabric housing 211 having an exterior 212 and an interior 213. A stuffing material 214 is disposed within the interior 123 so that the toy 200 assumes the approximate shape of a cube. Hook and loop fastener means, 218–220 (and three not shown) are disposed on each of the six sides of the cube. Tags 215–217 are releasably secured to the three hook and loop fastener means not shown, in a manner similar to that shown in FIGS. 14 and 15 and described with respect to the toy ball 140. In this embodiment, the length and width of each of the tags 215–217 are approximately one-fourth the height of the cube 201*c*.

The remaining three hook and loop fastener means 218–220 engage corresponding hook and loop fastener means on adjacent cubes 201*b*, 201*d*, and 201*f*, respectively, to join the smaller cubes together and form a portion of the larger toy 200. Alternatively, an additional tag could be secured to each of the remaining three hook and loop fastener means 218–220, so that the cube 201*c* could function as a stand alone toy, similar to the toy balls discussed above. In either case, the three tags 215–217 could also be secured to the cube 201*c* by means other than hook and loop fastener means, including any of the alternative fastening methods discussed above and shown in FIGS. 10–13 and 16–17.

Another potential variation is to connect adjacent hook and loop fastener patches with a strap that could either function as a conventional handle 227 extending between ends 228 and 229, or as an additional support 226 for holding adjacent blocks or cubes 201*a* and 201*b* together. This second option is particularly useful when it is desirable to connect a large number of such cubes together and create play structures and/or informal furniture for children.

Eight of the modules, of which 201*c* is a representative sample, are combined to form the larger cube shown in FIGS. 18 and 19. Recognizing that each of the blocks 201*a*–201*f* (and two not shown) has rounded corners, the blocks combine in a manner that forms a passageway along each of the axes of the cube 200. One such passageway is designated as 209 in FIG. 18. A flexible line 202 passes through one of these passageways in such a manner that a first end 203 of the line extends out one side of the large cube 200, and a second end 204 of the line extends out an opposite side of the large cube 200. A first plastic washer 205 is threaded onto the first end 203, and a second plastic washer 206 is threaded onto the second end 204. Each end of the line 202 is then knotted to retain a respective washer on the line, and each washer is sized to prevent a respective end of the line from entering the passageway. Thus, the large cube 200 is slideable along the flexible line 202 between its first and second ends 203 and 204, respectively. Alternatively, the ends of the flexible line 202 could be tied to one another to form a loop, in which case the large cube 200 would be continuously slideable along the flexible line 202.

A similar flexible line could be incorporated into any of the toy balls discussed above by using a large needle to thread a flexible line through the fabric housing. In this case, one may wish to secure an anchor member to an intermediate portion of the flexible line within the fabric housing. As long as the line on each side of the anchor member is longer than the diameter of the ball, the anchor member would eliminate the risk of pulling one end of the flexible line to such an extent that the other end is drawn into the fabric housing.

Figure 21:
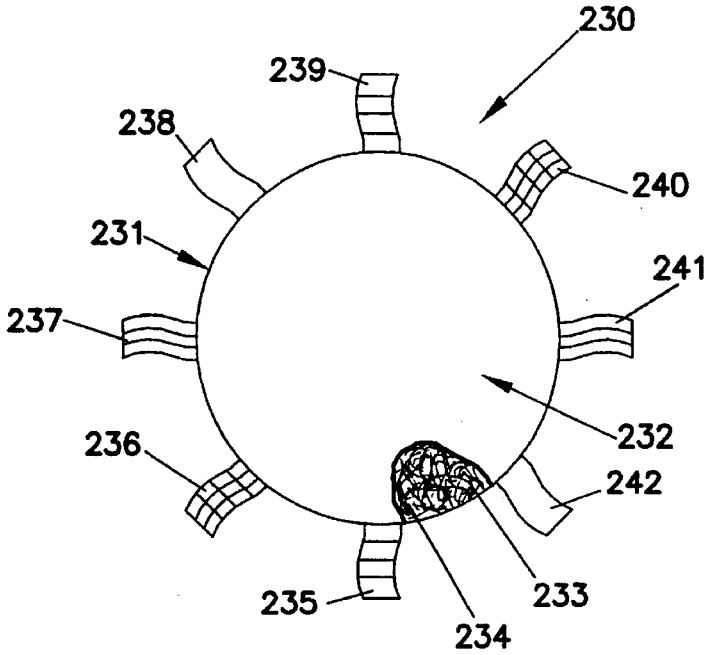
FIG. 21 is a front view of yet another stuffed toy constructed according to the principles of the present invention.
Figure 23:
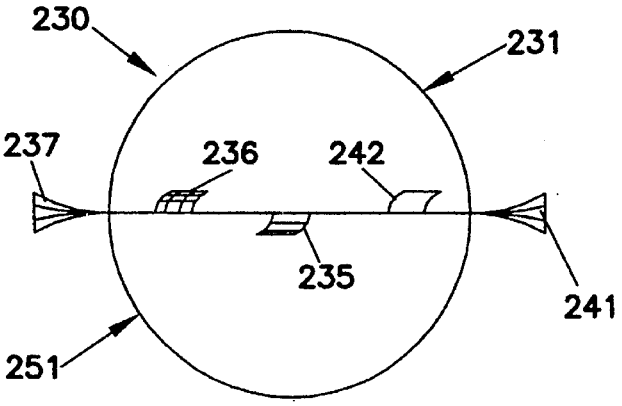
FIG. 23 is a side view of the stuffed toy shown in FIG. 21.
Figure 22:
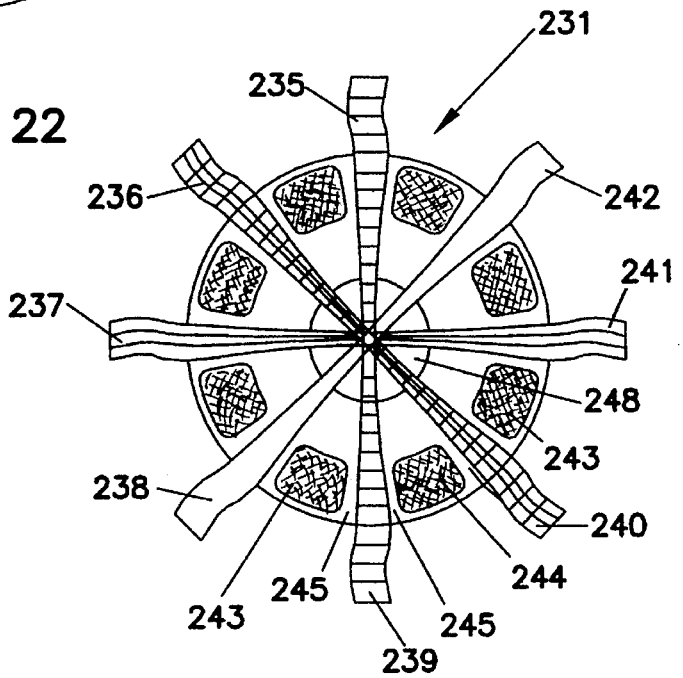
FIG. 22 is a rear view of a member forming a part of the stuffed toy shown in FIG. 21.

Yet another embodiment of the present invention is designated as 230 in FIGS. 21 and 23. A first member 231 and a second member 251 are releasably secured to one another to create the toy 230. The first member 231, which is similar to the second member 251, includes a fabric housing having an exterior 232 and an interior 233. A stuffing material 234 is disposed within the interior 233 so that the first member 231 assumes the approximate shape of a hemisphere. As shown in FIG. 22, patches of hook and loop fasteners 243 and 244 are secured in alternating fashion about the circumference of the flat, circular side of the first member 231. Each of the patches 243 are of the hook type, and each of the patches 244 are of the loop type. The patches 243 and 244 are spaced apart from one another to define gaps 245 therebetween.

A hemispherical void or cavity 246 is formed in the central portion of the flat, circular side of the first member 231. Several streamers or strips 235–242 are secured to the first member 231 proximate the cavity 246. In the embodiment shown, each of the strips is a portion of a longer strip sewn at some intermediate portion to the first member 231. In other words, strips 235 and 239 are integral parts of a single strip, as are strips 236 and 240, strips 237 and 241, and strips 238 and 242. However, in an alternative embodiment, each of the strips could terminate at the point of connection to the first member 231 proximate the cavity, and the strips could be clipped to the first member, rather than sewn, to facilitate interchangeability. In any of these embodiments, each of the strips 235–242 may be selectively extended along any of the gaps 245 and beyond the exterior 232, or alternatively, may be selectively folded into the cavity 246.

Recognizing that the second member 251 is substantially similar to the first member 231, the two members can be releasably secured to one another by aligning their respective hook and loop fastener patches so that the hook patches on the first member engage the loop patches on the second member, and the loop patches on the first member engage the hook patches on the second member. In this particular embodiment, the members 231 and 251 can assume any of four orientations relative to one another. The second member need not have a cavity formed therein, nor strips secured thereto, since the invention will function so long as a void is formed in at least one of the two members, and strips are secured to at least one of the two members, not necessarily the same member.

When the two members 231 and 251 are secured together, their hemispherical surfaces cooperate to define a spherical exterior, and their flat, circular surfaces (with at least one void formed therein) cooperate to define an interior cavity. The lengths of the strips are greater than the radius of the resulting sphere 230, so they can be positioned in the gaps 245 to extend beyond the exterior of the sphere 230 when the two members 231 and 251 are secured to one another. Some or all of the strips may bear different colors, designs, textures, and/or messages (including third party advertising). In the embodiment shown, diametrically opposed pairs of strips are colored so as to be distinguishable from other diametrically opposed pairs of strips. When assembled, the toy 230 appears as a round ball having different colored tags extending from a circumferential seam. In an alternative embodiment, the ball is separable into more segments to allow for more creative tag arrangements. For example, a ball that is separable into four quarter-spheres has strips extending beyond the exterior in a second plane, perpendicular to the first plane (defined by the flat, circular surfaces of the first and second members).

Figure 24:
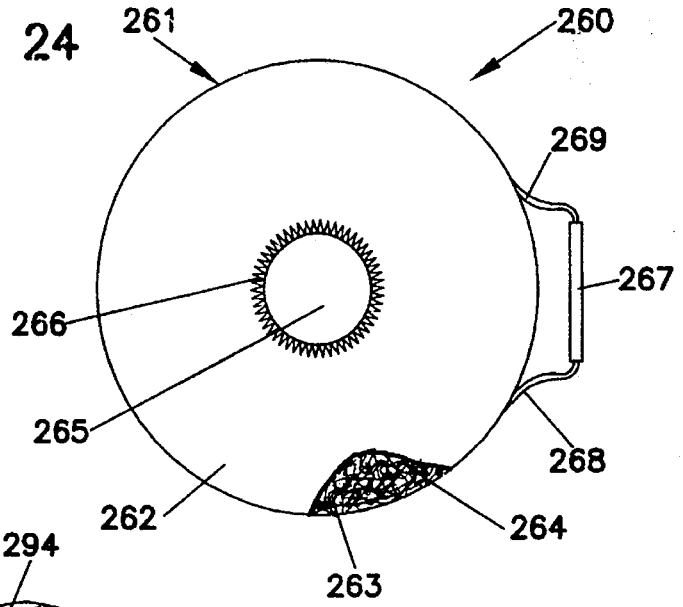
FIG. 24 is a front view of yet another stuffed toy constructed according to the principles of the present invention.
Figure 25:
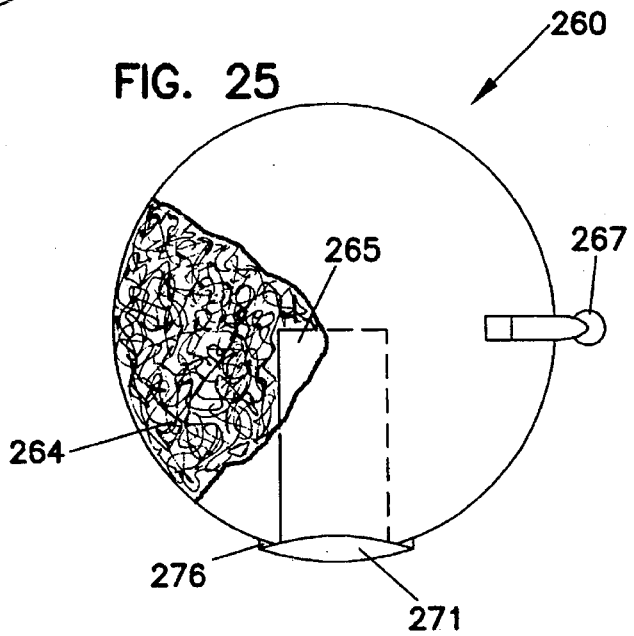
FIG. 25 is a side view of the stuffed toy shown in FIG. 24.

Yet another embodiment of the present invention is designated as 260 in FIGS. 24 and 25. The toy 260 includes a first member 261 and a second member 271 that are releasably secured to one another to create the toy ball 260. The first member 261 includes a fabric housing having an exterior 262 and an interior 263. A stuffing material 264 is disposed within the interior 263 so that the first member 261 assumes the approximate shape of a sphere having a bore 265 extending radially inward from the exterior surface of the sphere. A ring 266 of loop type fastener is disposed around the bore 265 on the surface of the sphere. A comparably configured ring 276 of hook type fastener is disposed on a cover 271. The hook and loop type fasteners 266 and 276 allow the cover 271 to be releasably secured over the bore 265, thereby creating an interior cavity wherein an object or streamers can be stashed. In addition to merely providing a hiding place, the cavity allows the ball to be asymmetrically weighted so that it wobbles when it is rolled or thrown.

As an additional, though not essential feature, a handle 267 is secured to the ball 260 by hook and loop fastener means 268 and 269 on the ends of the handle 267 and on the exterior surface 262 of the ball.

Figure 26:
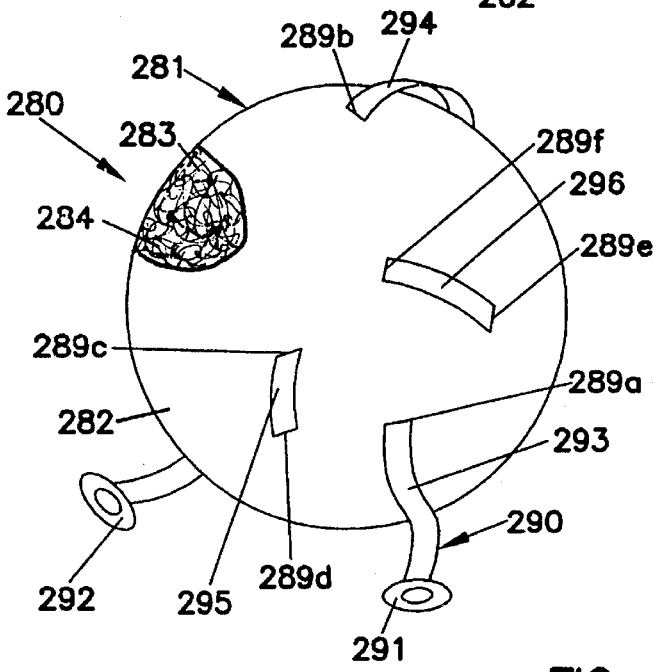
FIG. 26 is a front view of yet another stuffed toy constructed according to the principles of the present invention.

Yet another embodiment of the present invention is shown in FIG. 26. The stuffed ball 280 includes a fabric housing 281 having an exterior 282 and an interior 283. A stuffing material 284 is disposed within the interior so that the ball 280 assumes a substantially spherical shape. A long strip 290 extends between a first end 291 and a second end 292. At least one of the ends 291 and 292 is threaded through holes 289*a*–289*f* (and several not shown) in the exterior 282 of the fabric housing 281, leaving portions 291–296 of the strip 290 on the exterior of the ball, and other portions (not shown) of the strip 290 on the interior of the ball. Each of the ends 291 and 292 is fitted with a stopper to prevent the ends from entering the interior of the ball. The resulting toy provides a series of segments or tags that may be pulled relative to the ball, as well as one another.

The present invention has been described with reference to specific embodiments. However, those skilled in the art will recognize additional embodiments and applications that fall within the scope of the present invention. Accordingly, the present invention is to be limited only by the appended claims.

What is claimed is:

1. A stuffed toy, comprising:

a plurality of fabric segments sewn together to form a fabric housing having an interior, an exterior, and seams extending between adjacent fabric segments;

a soft stuffing material disposed within the interior of the fabric housing to form an essentially spherical ball free to roll in any direction; and at least six cloth tags which are essentially planar and have essentially rectangular ends, the tags sewn within the seams of the fabric housing and extending at least one inch outward from the exterior of the ball, one tag proximate each point of intersection between the fabric housing and three orthogonal diameters of the ball, whereby at least one tag is visible and accessible to an infant regardless of how the stuffed toy is oriented relative to the infant.

2. A stuffed toy according to claim 1, wherein precisely six tags are sewn within the seams of the fabric housing.

3. A stuffed toy according to claim 1, wherein a first informational item is disposed on one of the tags, and a second informational item is disposed on another of the tags.

4. A stuffed toy according to claim 1, wherein at least one of the cloth tags is sewn within each of the seams extending between adjacent fabric segments.

5. A stuffed toy according to claim 1, wherein each of the cloth tags bears identical written information regarding the stuffed toy, whereby all but one of the tags is redundant from an informational perspective.

6. A stuffed toy according to claim 1, wherein more than one of the cloth tags is visible and accessible to an infant regardless of how the stuffed toy is oriented relative to the infant.

* * * * *